US006218740B1

(12) United States Patent
Mildice

(10) Patent No.: US 6,218,740 B1
(45) Date of Patent: Apr. 17, 2001

(54) INTEGRATION MODULE FOR SUPPLEMENTAL VEHICLE CONTROLLERS

(75) Inventor: Mark W. Mildice, Vista, CA (US)

(73) Assignee: Directed Electronics, Inc., Vista, CA (US)

( * ) Notice: Subject to any disclaimer, the term of this patent is extended or adjusted under 35 U.S.C. 154(b) by 0 days.

(21) Appl. No.: 09/288,473

(22) Filed: Apr. 8, 1999

(51) Int. Cl.[7] ..... H01R 9/09

(52) U.S. Cl. ..... 307/10.1; 707/9.1; 707/42; 707/147; 439/76.2

(58) Field of Search ..... 307/10.1, 9.1, 307/42, 147; 324/539, 540, 66, 503; 73/118.1; 439/76.2, 949

(56) References Cited

U.S. PATENT DOCUMENTS 4,814,693 * 3/1989 Cohen ..... 324/66
5,315,252 * 5/1994 Puetz et al. ..... 324/503
5,535,620 * 7/1996 Nichols ..... 73/118.1
5,897,385 * 4/1999 Kasai ..... 439/949
5,971,623 * 10/2000 Wanamker ..... 385/53

* cited by examiner

*Primary Examiner*—Albert W. Paladini
(74) *Attorney, Agent, or Firm*—Sam Talpalatsky

(57) ABSTRACT

An integration module connected to the output of a vehicle controller on the one end and wire harnesses originally connected to the vehicle controller on the other. A circuit board connecting the input and the output of the integration module connections, wherein one or more of the connections is to a primary path controlling one or more functions or inputs of a user control or appliance or function in the vehicle such as a door, window or trunk. A supplemental path connected to the primary path on the one end and a connector of the integration module on the other. Said connector joined with a wire harness connecting the integration module and a supplemental controller such as a security system or a keyless entry system. The above structure allowing the installer to employ the integration module providing some or all connections to the primary paths necessary to control certain vehicle functions or appliances without having to isolate and splice into said primary paths individually.

23 Claims, 2 Drawing Sheets

PL = Parking Lights (-) White
DLS = Dome Light Supervision (-) Black/White
Hrn = Horn (-) Brown
DT = Door Trigger (-)Green
TT = Trunk/glass Trigger (-) Blue
Gnd = Ground (-) Black
IGN = Ignition (+) Yellow 1 Amp Max
12+ = 12 volt positive (+) Red 5 Amp Max
TR = Trunk/glass Release (-) Red/White
ADU = All Door unlock (-) Blue
DDU = Drivers Door unlock (-) Blue/Black
DL = All Door Lock (+) Green

INTEGRATION MODULE FOR SUPPLEMENTAL VEHICLE CONTROLLERS

FIELD OF THE INVENTION

This invention relates to the art of vehicle security systems or supplemental controllers such as a vehicle convenience system or keyless entry system. More particularly, this invention relates to the new and unobvious integration module that allows the installer to easily integrate a supplemental controller into a vehicle system partially or completely eliminating the need to splice into the wiring or harnesses of a vehicle.

DESCRIPTION OF THE PRIOR ART

Today's vehicles are very sophisticated and complex. They combine mechanical state of the art together with electronic controls, monitoring and sensory inputs. One or more processors collect and process information to deliver performance, efficiency and comfort to the user. These processors control fuel delivery, emissions, safety responses, and user controllable functions or appliances (hereafter "functions") such as, but not limited to, keyless entry, window control, trunk access, climate control, audio systems, video systems, global positioning and/or navigation displays. The list of user convenience features is growing each year.

Because not every vehicle is built with every electronic accessory, the market for these accessories is flourishing. Today the consumer has a choice of adding accessories such as security, keyless entry, navigation, telecommunications, computers, audio, and/or video systems to his or her vehicle. These accessories are controlled with a supplemental controller, which often operates the same functions as another controller of the vehicle. For example, keyless entry system controls the power door locks of the vehicle, which function may also be controlled by the body controller of the vehicle. Another example is the trunk release solenoid that is controlled by the body controller and by the security system or keyless entry system. Yet another example is power windows that are controlled by the body controller and the security system or keyless entry system.

Prior to the present invention, installers of these systems had to identify and isolate the specific wires stemming from the vehicle controller and splice into these wires. Moreover, installers often had to add additional interface circuitry such as diodes, resistors, relays, inductors, capacitors and/or amplifiers to complete the circuit. This practice is disadvantageous for a number of reasons. Isolation of the right wires is difficult and the wires are often not readily accessible. Splicing into the wires requires careful attention to disassembly and assembly. Wires have to be carefully and professionally isolated so as not to cause sparks, shorts, malfunction or rattles. Additionally, locating, splicing, disassembling and reassembling a vehicle is time consuming and expensive. Therefore, there remains a need for an efficient way to interface supplemental controllers with the existing wiring harnesses of a vehicle to eliminate some or all of the requisite splicing into the existent wiring of a vehicle to control user controllable functions and appliances such as doors, trunk, window, lights, audio, video, security, communications, telecommunications, computers, seat position, climate control and navigation to name a few examples.

SUMMARY OF THE INVENTION

The present invention is an integration module that provides a clean, accurate, efficient and professional installation of one or more supplemental controllers such as a security system. In the preferred embodiment of the invention, the integration module is matched to the body controller of the specific vehicle or platform. Namely, it has a set of inputs, outputs and a connection for one or more harnesses for a supplemental controller. In the preferred embodiment, if the body controller has three female output connectors connected to the respective male connectors that are a part of wire harnesses, the integration module has a set of respective female inputs and integration wire harnesses having male end connectors on each terminal end. Accordingly, in the example above, the original wire harnesses of the vehicle are disconnected from the body controller, first male ends of the integration wire harness are connected to the body controller and its opposite end are connected to the corresponding integration module inputs. On the output end of the integration module, the original disconnected wire harnesses are connected to the corresponding female connector outputs of the integration module. Accordingly, connection to the control wires of the vehicle is clean and efficient, as the original connectors are unplugged, the integration module is plugged in their place and the connections between the body controller and the original connectors are reestablished by plugging the original connectors into the outputs of the integration module.

The input and the output connections through the integration module are maintained through a circuit board. Because the supplemental controller seeks access to certain traces (primary paths), connections to these traces are provided on the circuit board. The select traces are then connected to an output connector, which in turn is connected to a harness leading to the supplemental controller. This, therefore, provides a clean, accurate, reliable, time and cost efficient installation because the installer does not have to isolate the correct wires emanating from the body controller and splice into them.

Moreover, circuitry can be placed on the circuit board to isolate the supplemental controller from the body controller or the functions that it controls. As an example, isolation diodes can be placed on the circuit board. Another example is placing light-flash relays on the circuit board. This allows the manufacturer of the integration module to place the circuitry on the board efficiently and error free.

It is, therefore, the object of the present invention to provide an integration module that provides a clean, accurate, efficient and professional installation of one or more supplemental controllers such as a security system. It is the object of the present invention to provide an integration module that is matched to the body controller of a vehicle. It is the object of the present invention to provide an integration module having at least one input and output connector, wherein the input connectors are joined with the output of the body controller and output connector are joined with the wiring harnesses that originally joined with the body controller. It is the object of the present invention to provide a circuit board connecting the input and the output connections through the integration module. It is the object of the present invention to provide connection to select traces/primary paths of the circuit board. It is the object of the present invention to connect the select traces to an output connector via one or more supplemental traces that are connected to a harness leading to the supplemental controller. It is the object of the present invention to provide a clean, accurate, reliable, time and cost efficient installation. It is a further object of the present invention to place circuitry or electronic components on the circuit board between one or more primary pths and supplemental paths to interface with or isolate the supplemental controller and the body controller or the functions that they control.

These and other objects of the invention may be found from a fair reading of the description of the preferred embodiment taken along with the drawings appended hereto. The scope of protection sought by the inventors may be gleaned from a fair reading of the claims that conclude this specification.

DETAILED DESCRIPTION

Figure 1:
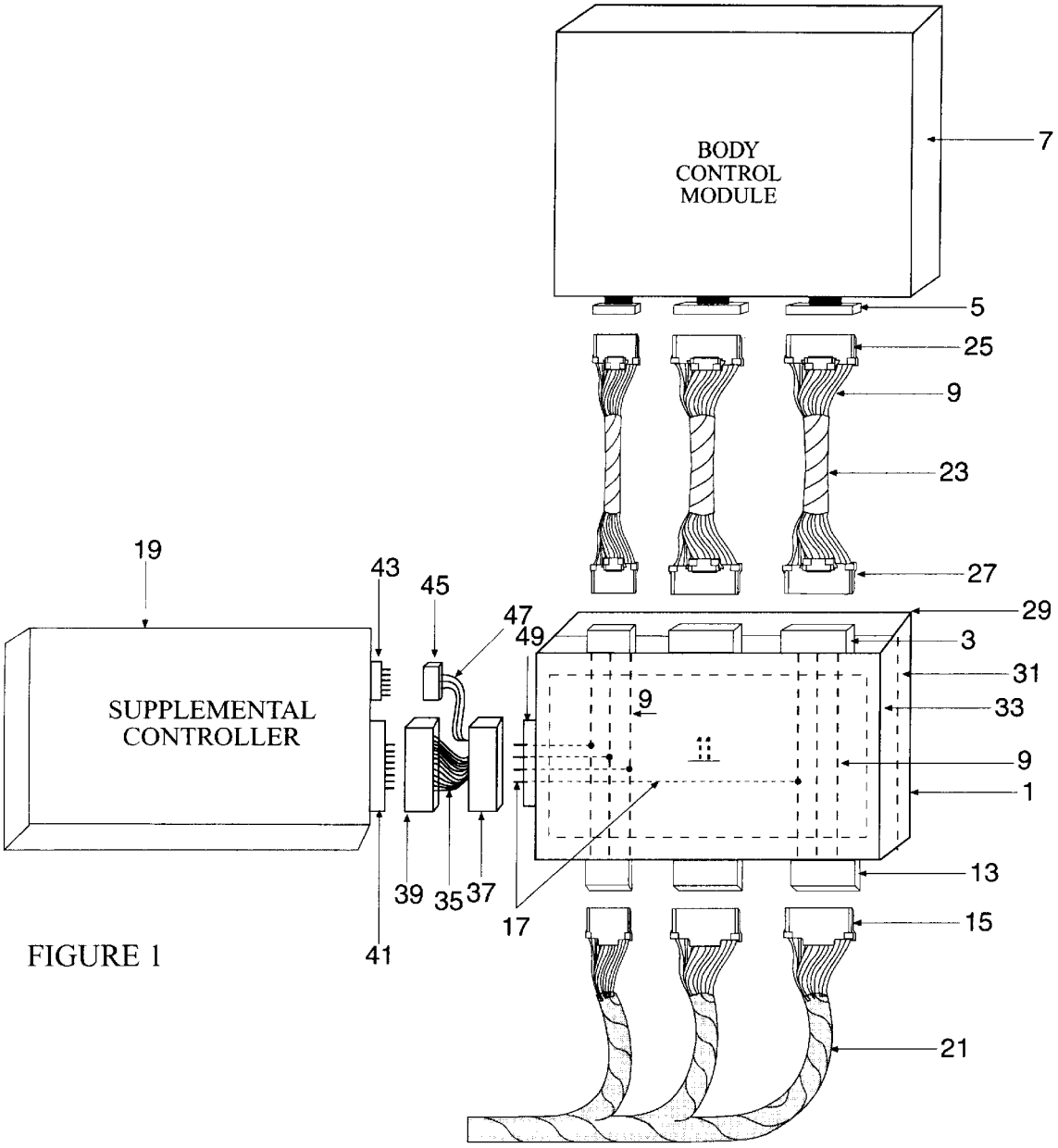
FIG. 1 is a top plan view of the integration module connected between the harnesses and the body controller module.

As shown in FIG. 1, many vehicles are equipped with a body control module 7. Body control module 7 controls a number of user controllable functions, including without limitation, door lock and unlock, trunk release, window control, light control, audio control, video control, climate control telecommunications, navigation, computing and the like. Therefore, body control module 7 is connected to the solenoids, motors or electronics that control or operate these vehicle functions. Connected to body control module 7 is at least one output connector 5. Usually, the output connectors 5 are multi-pin, female connectors, but they can be chosen from many different connectors. At least one corresponding wire harness 21, terminating in at least one input connector 15, mates with output connector 5 and provides efficient coupling of a number of wires to and from body control module 7. As indicated above, the wires in one or more harnesses 21 may be power, ground, window control, trunk control, door control, light control, audio control, video control, seat position control, climate control, navigation control, telecommunications control and/or other controllable functions of the vehicle.

In the description of this invention, reference will be made to at least one primary path 9. Primary path 9 may be any one or more electrical connections/paths/traces to which or from which a supplemental controller 19 requires access to either receive the status of a vehicle function or to control a vehicle function. Accordingly, primary path 9 connects to body control module 7 and runs through output connector 5, input connector 15 and wire harness 21 to its final destination, such as a door or trunk solenoid (not shown).

For purposes of disclosing the preferred embodiment of the invention and with the understanding that the same principles apply to any supplemental controller requiring access to at least one primary path 9, the remainder of the disclosure herein is described with reference to a supplemental controller 19 that in the preferred embodiment is a vehicle security system or a keyless entry system, although it can be any device that requires access to at least one primary path 9.

Prior to the device of the present invention the installer of supplemental controller 19 had to splice into wiring harnesses 21. First, he had to locate the correct harness 21 among many other harnesses. Then he had to isolate the correct wire in that harness representing primary path and splice into primary path 9 that supplemental controller 19 was going to control or sense (i.e. ignition as an example). This at times required disassembly of the dash of the vehicle and the professional factory packaging of one or more wire harnesses 21. Often, the installer was not certain whether or not he had isolated the correct harness 21 or the correct primary path 9. Trial and error often resulted in a waste of time and unnecessary disassembly of the vehicle. If the installation was less than professional, the spliced connections caused malfunctions.

The device of the present invention provides an integration module 1. Integration module 1 has one or more first connectors 3 and one or more second connectors 13. Second connectors 13 are preferably the same gender as each respective output connector 5 to allow input connectors 15 to be plug compatible with second connectors 13. As an example, if output connector 5 is a female connector, second connector 13 is also a female connector with the same key and pin count (not shown) to accept input connector 15. To place integration module 1 between input connectors 15 and output connectors 5, input connectors 15 and associated harnesses 21 are disconnected from body control module 7 and are connected to respective second connectors 13 of integration module 1. Integration module 1 is then connected to body control module 7 via at least one mating harness 23 having a pair of connectors 25 and 27. Connectors 25 are selected to be compatible with respective output connectors 5. Therefore, if output connector 5 is a female connector, connector 25 mating therewith is a male connector with a matching key and pins (not shown). Similarly, connectors 27 are matched to mate with first connector 3. In the preferred embodiment, connectors 25 and 27 are the same. Although detachable harnesses 23 are the preferred embodiment of the invention, they can be hardwired into integration module 1 overcoming the need of connectors 27 and 3.

Integration module 1 includes a housing 29 enclosing a circuit board 11. Housing 29 preferably consists of a top cover 33 and a bottom cover 31. Covers 31 and 33 house circuit board 11 and are secured together by snap-fit arrangement or, as in the preferred embodiment, by one or more screws (not shown) about covers 33 and 35. When assembled, housing 29 includes three openings: one or more first openings for one or more connectors 3, one or more second openings for one or more second connectors 5 and one or more third openings for one or more third connectors 49. In the preferred embodiment, there is a single connector 49, which is a multi-pin, male connector connecting with an auxiliary harness 35 via connector 37. Auxiliary harness 35 has at least two terminal connectors 37 and 39 for respective plug compatibility with connector 49 of integrator module 1, on one end, and fourth connector 41 of supplemental controller 19 on the other end. Therefore, as will be discussed in detail below, one or more supplemental paths 17 provide an electrical connection from one or more primary paths 9 to connectors 41 and 43 of supplemental controller 19. Supplemental paths 17 run from circuit board 11 through third connector 49, connector 37, harness 35, connectors 39 and 45 and fourth connectors 41 and 43. Each primary path 9 connected via integration module 1 to supplemental controller 19 eliminates the installation and a splicing that has to be performed by the installer. This reduces time, defects and costs and adds value in a form of a clean, accurate, efficient and reliable installation.

Harness 35 of the preferred embodiment may also have a secondary harness 47 terminating in connector 49 on one end and connector 45 on the other. In supplemental controller 19 of the preferred embodiment, connection to and from supplemental controller 19 are segregated in two or more connectors 41 and 43 respectively. Accordingly, an additional connector 45 is attached to the secondary harness 47 that mates with fourth connector 43 of supplemental controller 19.

Figure 2:
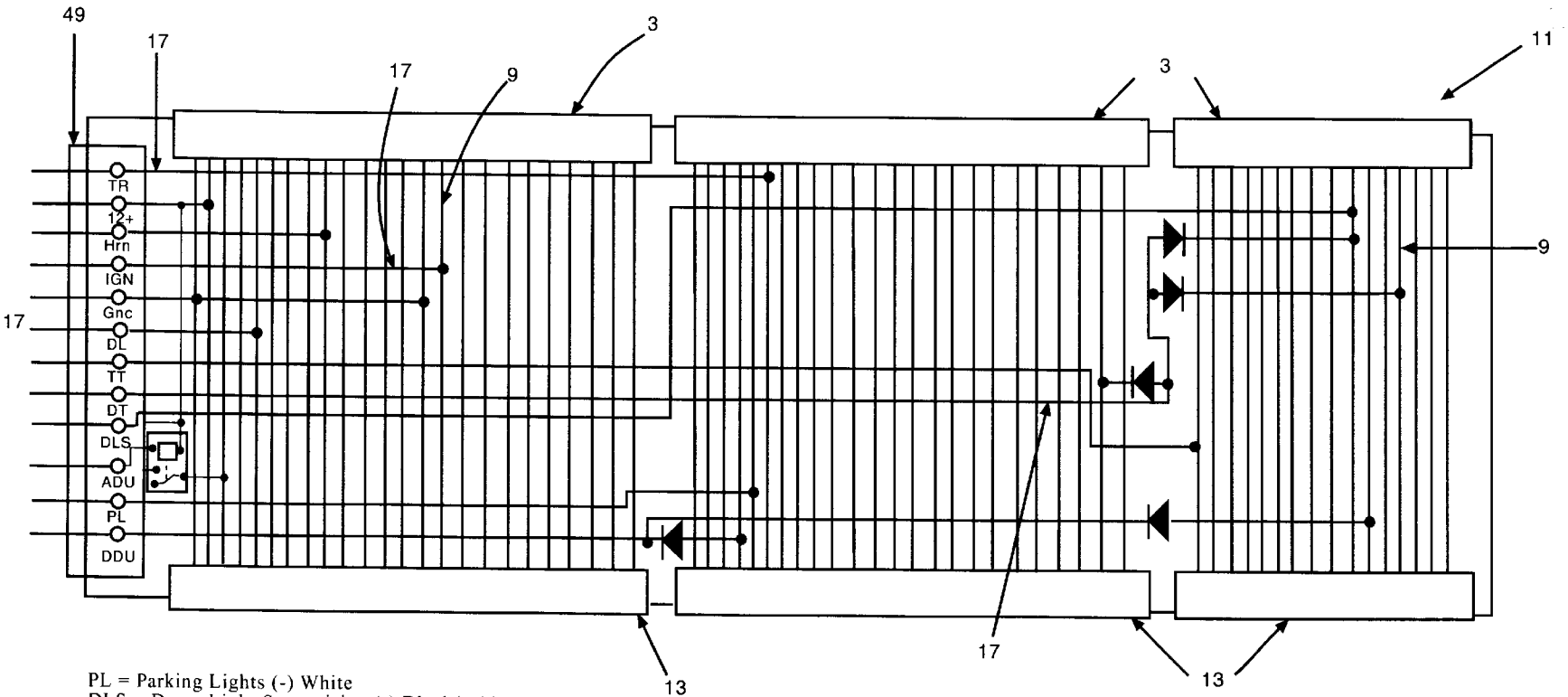
FIG. 2 is a schematic of the circuit board of the integration module.

As disclosed above, integration module 1 includes circuit board 11, the schematic diagram of which is illustrated in FIG. 2. It should be further noted that this schematic, as an example, is constructed for one of General Motors' vehicle platforms, however, this invention is not limited thereto. The same concepts can be applied to any vehicle platform. The top three horizontal blocks represent first connectors 3, and the bottom three blocks represent second connectors 13. As is evident from this schematic, circuit board 11 provides feed-through coupling/connections between the corresponding pins of respective connectors 3 and 13. Circuit board 11 further provides the medium necessary to electrically connect/couple one or more primary paths 9 to third connector 49 via supplemental paths 17. As an example, if an electrical connection to a primary path 9 was required by supplemental controller 19, the trace on board 1 that is identified as the primary path 9 of interest would be connected to supplemental path 17, which path 17 would be connected to connector 49 and supplemental controller 19. As further shown in FIG. 2, electrical components including without limitation relays, diodes, resistors, capacitors, inductors, attenuators, timers, logic gates and the like, may be conveniently integrated onto board 11 between primary path 9 and supplemental path 17. This further reduces the installation time of supplemental controller 19 and its components and provides for a clean, accurate, efficient and reliable installation.

While the invention has been described with reference to a particular, preferred embodiment thereof, those skilled in the art will be able to make various modifications to the described embodiment of the invention without departing from its true spirit and scope. It is intended that all combinations of elements and steps which perform substantially the same function in substantially the same way to achieve substantially the same result, are within the scope of this invention.

I claim:

1. An integration module providing at least one of input and output emanating from a control module of a vehicle to a supplemental controller, said integration module comprising:

a) at least one first connector electrically connected to at least one output connector of a control module, said output connector and said first connector respectively forming at least one primary path having terminal ends, said first end emanating from said control module and said second end connected to at least one vehicle controllable function;

b) said first connector connecting said at least one primary path through a circuit board having at least one electrically conductive trace so as to continue said primary path across said trace and connect said at least one primary path to at least one second connector;

c) at least one input connector connected to a wire harness mating with said at least one second connector to connect said at least one primary path emanating from said control module to control said at least one vehicle controllable function; and d) a supplemental path connected to said at least one primary path and said supplemental controller.

2. The device of claim 1 further comprising interface circuitry connected between said at least one primary path and said at least one supplemental path.

3. The device of claim 2 wherein said interface circuitry comprises at least one diode.

4. The device of claim 2 wherein said interface circuitry comprises at least one relay.

5. The device of claim 2 wherein said interface circuitry comprises at least one resistor.

6. The device of claim 2 wherein said interface circuitry comprises at least one capacitor.

7. The device of claim 2 wherein said interface circuitry comprises at least one inductor.

8. The device of claim 2 wherein said interface circuitry comprises at least one amplifier.

9. The device of claim 2 wherein said interface circuitry comprises at least one timer.

10. The device of claim 2 wherein said interface circuitry comprises at least one logic gate.

11. The device of claim 2 wherein said interface circuitry comprises at least one attenuator.

12. The device of claim 2 wherein said interface circuitry is chosen from a group consisting of at least one of a diode, a relay, a capacitor, a resistor, an inductor, an attenuator, an amplifier, a timer or a logic gate.

13. The device of claim 2 wherein said at least one primary path is connected to at least one of a window control or a window motor of said vehicle.

14. The device of claim 2 wherein said at least one primary path is connected to at least one of a door lock/unlock control or a door lock/unlock solenoid of said vehicle.

15. The device of claim 2 wherein said at least one primary path is connected to at least one of a trunk release control or a trunk release solenoid of said vehicle.

16. The device of claim 2 wherein said primary path is connected to at least one of a seat control or a seat motor of said vehicle.

17. The device of claim 2 wherein said primary path is connected to at least one of an audio control or an audio component of said vehicle.

18. The device of claim 2 wherein said primary path is connected to at least one video component of said vehicle.

19. The device of claim 2 wherein said primary path is connected to at least one climate control of said vehicle.

20. The device of claim 2 wherein said primary path is connected to at least one of a light control or a light of said vehicle.

21. The device of claim 2 wherein said primary path is connected to at least one of a windshield wiper control or a windshield wiper of said vehicle.

22. The device of claim 2 wherein said primary path is connected to at least one of a navigation control or a navigation component of said vehicle.

23. An integration module providing at least one input or output emanating from a control module to a supplemental controller, said integration module comprising:

a) at least one first connector electrically connected to at least one output connector of a control module, said output connector and said first connector respectively forming at least one primary path having terminal ends, said first end emanating from said control module and said second end connected to at least one vehicle controllable function;

b) said first connector running said at least one primary path through a circuit board having at least one electrically conductive trace so as to continue said path across said trace and connect said at least one primary path to at least one second connector;

c) at least one input connector mating with said at least one second connector connecting said at least one primary path emanating from said control module to control said at least one vehicle controllable function;

d) interface circuitry connected between said at least one primary path and at least one supplemental path connected to said supplemental controller; and e) at least one third connector connecting said supplemental path connected to said interface circuitry with at least one fourth connector emanating from said supplemental controller.

* * * * *